US010519904B2

(12) United States Patent
Cho

(10) Patent No.: US 10,519,904 B2
(45) Date of Patent: Dec. 31, 2019

(54) VEHICLE AIR DUCT FOR REDUCING INTAKE NOISE

(71) Applicants: HYUNDAI MOTOR COMPANY, Seoul (KR); KIA MOTORS CORPORATION, Seoul (KR)

(72) Inventor: Yoon-Geun Cho, Daegu (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/374,777

(22) Filed: Dec. 9, 2016

(65) Prior Publication Data

US 2018/0112635 A1 Apr. 26, 2018

(30) Foreign Application Priority Data

Oct. 26, 2016 (KR) ..... 10-2016-0140335

(51) Int. Cl.
*F02M 35/12* (2006.01)

(52) U.S. Cl.
CPC ..... *F02M 35/1211* (2013.01)

(58) Field of Classification Search
CPC ..... F02M 35/1211; F02M 35/10013; F02M 35/1261
See application file for complete search history.

(56) References Cited

U.S. PATENT DOCUMENTS

RE40,621 E * 1/2009 Choi ..... F02D 9/104 123/184.53
7,631,726 B2 * 12/2009 McWilliam ..... F02M 35/1211 181/206
8,327,975 B2 * 12/2012 Ortman ..... F02B 33/44 123/184.53
8,485,311 B2 * 7/2013 Mackenzie ..... F02M 35/10137 123/184.21
2005/0150718 A1 * 7/2005 Knight ..... F01N 1/02 181/250
2010/0018498 A1 * 1/2010 Hirose ..... F02B 31/04 123/337
2010/0193282 A1 * 8/2010 Kim ..... F04D 29/665 181/229
2011/0146612 A1 * 6/2011 Kusuda ..... F02M 35/10321 123/184.53

(Continued)

FOREIGN PATENT DOCUMENTS

JP 434457 U1 3/1992
JP 2004285876 10/2004

(Continued)

*Primary Examiner* — Xiao En Mo
(74) *Attorney, Agent, or Firm* — Lempia Summerfield Katz LLP

(57) ABSTRACT

An air duct for a vehicle functions to reduce intake noise and includes an outer housing configured having a pipe shape so that outside air is introduced into an engine therethrough. The air duct also has an inner pipe fixed in the outer housing so that an outer surface of the inner pipe is spaced apart from an inner surface of the outer housing, thereby partitioning the inside of the outer housing in a radial direction. A space between the inner pipe and the outer housing communicates with the inside of the inner pipe.

6 Claims, 6 Drawing Sheets

(56) References Cited

U.S. PATENT DOCUMENTS

| | | | | |
|---|---|---|---|---|
| 2011/0299981 | A1* | 12/2011 | Li | F02M 35/10157 415/206 |
| 2013/0092472 | A1* | 4/2013 | Ostler | F02M 35/1216 181/256 |
| 2015/0107935 | A1* | 4/2015 | Dobrin | F02M 35/1261 181/214 |

FOREIGN PATENT DOCUMENTS

| | | |
|---|---|---|
| JP | 2008223745 | 9/2008 |
| KR | 20-0155736 | 9/1999 |

* cited by examiner

VEHICLE AIR DUCT FOR REDUCING INTAKE NOISE

CROSS-REFERENCE TO RELATED APPLICATIONS

This application claims priority to and the benefit of Korean Patent Application No. 10-2016-0140335, filed on Oct. 26, 2016, which is incorporated herein by reference in its entirety.

BACKGROUND

Field of the Disclosure

The present disclosure relates to an air duct used to introduce air into an engine of a vehicle, and more particularly, to an air duct for a vehicle that reduces intake noise.

Description of Related Art

An air duct for introducing air into an engine of a vehicle is installed in an engine compartment of the vehicle.

As illustrated in FIG. 1, foreign material in the air that is introduced into the air duct 110 are filtered in an air cleaner 130, and the filtered air is introduced or delivered to the engine. Further, a silencer 120 for reducing noise that is generated by air intake or inversely transferred from the engine is separately installed at one side of the air duct 110. The silencer 120 includes a body 122 and a cover 121, and is installed at one side of the air duct 110.

The silencer 120 needs to be installed in the narrow engine compartment, thus it is not easy to secure a space for installing the silencer 120.

Further, since a shape of a portion of the silencer 120 to which the air duct 110 is coupled is different for each vehicle specification, the silencer 120 should be manufactured to have various specifications or models that correspond to the different vehicles. A shape of a portion of the air duct 110 to which the silencer 120 is coupled is also different for each silencer specification. Thus, the air duct 110 also needs to have various specifications, as well as the silencer 120.

Accordingly, the structure of a portion of the air duct where the silencer 120 is installed becomes complicated, and it is disadvantageous in cost or weight due to addition of the silencer 120. Further, since the air duct 110 and the silencer 120 of various specifications need to be managed, the number of operating specifications becomes excessively large.

SUMMARY OF THE DISCLOSURE

An embodiment of the present disclosure is directed to an air duct for a vehicle, the air duct configured to reduce intake noise without the need for using a separate silencer. The disclosed air duct is formed to have a double pipe shape.

Other objects and advantages of the present disclosure can be understood by the following description, and will become apparent to those having ordinary skill in the art with reference to the embodiments of the present disclosure. Also, those having ordinary skill in the art to which the present disclosure pertains will become aware that the objects and advantages of the present disclosure can be realized by the features and elements as claimed and by various combinations thereof.

In accordance with an embodiment of the present disclosure, an air duct for a vehicle functions to reduce intake noise. The disclosed air duct includes: an outer housing configured having a pipe shape to introduce outside air therethrough into an engine, and an inner pipe fixed in the outer housing and configured so that an outer surface of the inner pipe is spaced apart from an inner surface of the outer housing, thereby partitioning the inside of the outer housing in a radial direction. A space between the inner pipe and the outer housing communicates with the inside of the inner pipe.

Partition walls extending from the inner pipe toward the outer housing may be formed at portions of the inner pipe is fixed to the outer housing.

The partition walls may be disposed at plural positions and spaced apart from each other.

Among the partition walls, a front partition wall may be formed at a side at which the air is introduced into the air duct and may extend from a front end of the inner pipe in a radial direction of the inner pipe.

Among the partition walls, a rear partition wall may be spaced apart from the front partition wall, and may be positioned spaced apart from a rear end of the inner pipe by a predetermined distance.

A distance between the front partition wall and the rear partition wall may be greater for engines of higher displacement and lesser for engines of smaller displacement.

Circumferential edges of the partition walls may closely adhere to or contact the outer housing.

Assembly grooves may be formed in the inner surface of the outer housing to accommodate the circumferential edges of the partition walls.

A front assembly groove may be formed in the inner surface of the outer housing at a predetermined position where the front partition wall is positioned to accommodate the front partition wall.

A rear assembly groove may be formed in the inner surface of the outer housing at a predetermined position where the rear partition wall is positioned to accommodate the rear partition wall.

An O-ring may be installed at the circumferential edges of the partition walls to create air-tight contact between the circumferential edges of the partition walls and the inner surface of the outer housing.

A hole is formed penetrating through the inner pipe. The hole provides air flow communication between the space defined within the inner pipe and the outer housing and the inside of the inner pipe.

The hole may be formed between the partition walls.

The hole may be formed with a neck surrounding the hole and extending from the inner pipe toward the outer housing at a predetermined length.

A frequency to be reduced may be determined by varying a diameter of the hole and a length of the neck.

DESCRIPTION OF SPECIFIC EMBODIMENTS

Hereinafter, an air duct for a vehicle having a function of reducing intake noise in accordance with the present disclosure is described in detail with reference to the accompanying drawings.

Figure 1:
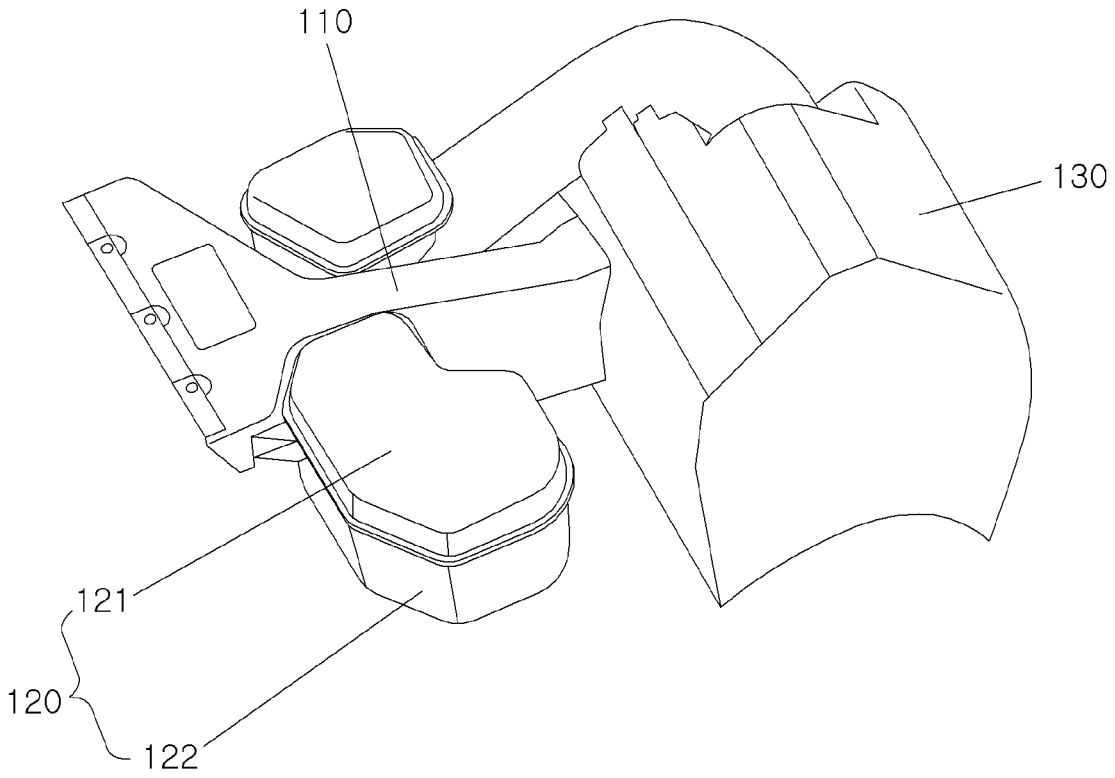
FIG. 1 is a perspective view illustrating an air duct according to the related art and having a silencer and an air filter.
Figure 2:
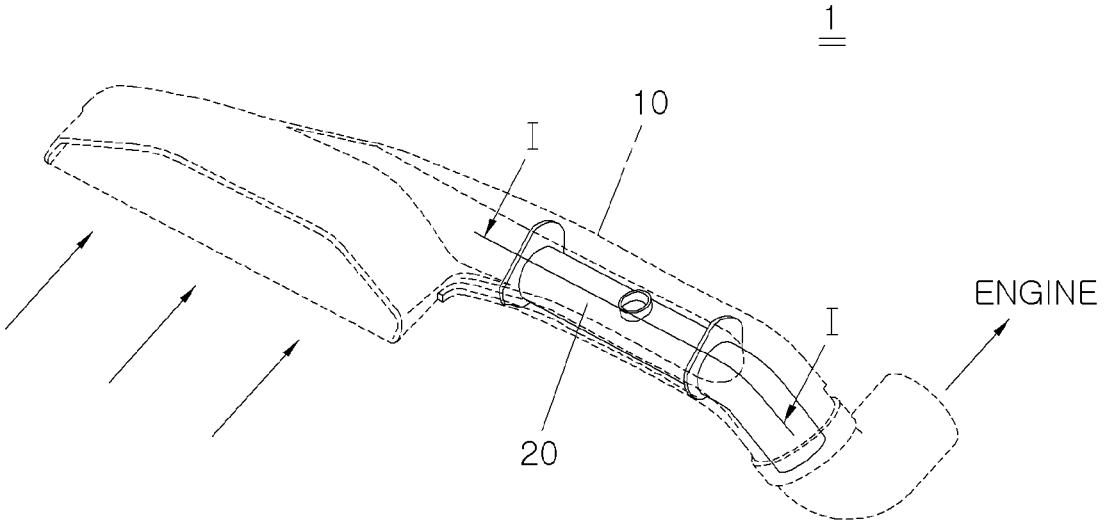
FIG. 2 is a perspective view illustrating an air duct for a vehicle and constructed to reduce intake noise in accordance with the present disclosure.
Figure 3:
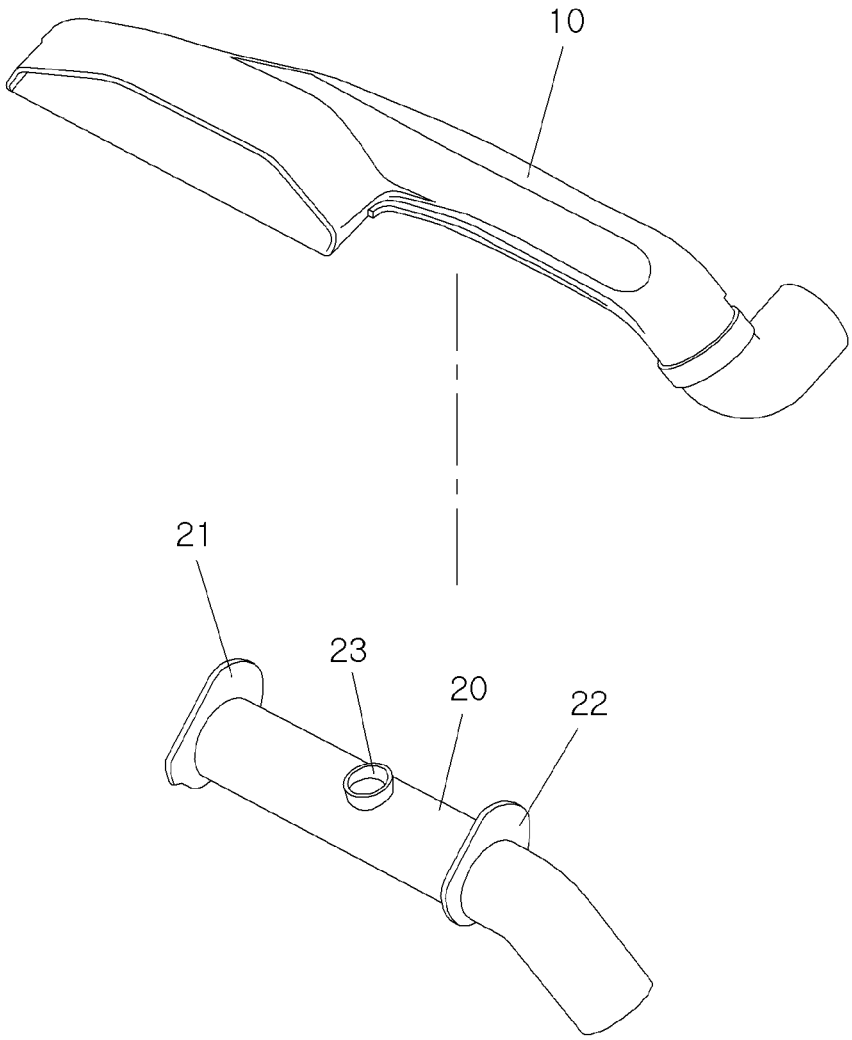
FIG. 3 is an exploded perspective view illustrating an outer housing and an inner pipe of the air duct of FIG. 2 and in accordance with the present disclosure.

An air duct 1 for a vehicle is shown in FIGS. 2 and 3. The air duct 1 functions to reduce intake noise in accordance with the present disclosure. The air duct 1 includes an outer housing 10 configured to be formed in a pipe shape so that outside air is introduced or directed into an engine in a flow direction shown by the arrows in FIG. 2 through the air duct. The air duct 1 also has an inner pipe 20 configured to be fixed in the outer housing 10 so that an outer surface thereof is spaced apart from an inner surface of the outer housing 10. The arrangement divides or partitions the inside of the outer housing 10 in a radial direction.

Figure 4:
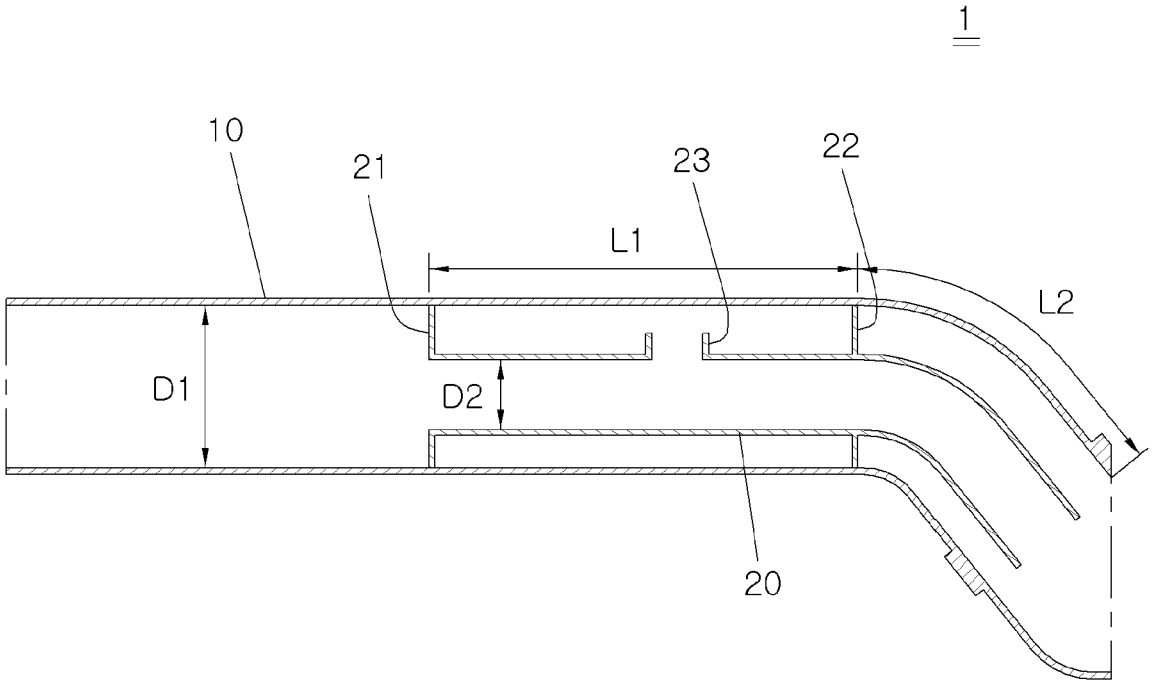
FIG. 4 is a cross-sectional view illustrating the air duct of FIG. 2 and in accordance with the present disclosure.

As shown in FIGS. 2 and 4, the outer housing 10 defines a path through which outside air is introduced into the engine of the vehicle. The outer housing 10 is formed in a pipe shape to allow the air to flow through the outer housing. The outer housing 10 has a diameter D1 that is sufficiently sized to allow a required amount of air to flow through the outer housing at the time of maximum output of the engine.

The inner pipe 20 is fixedly installed in the outer housing 10. The inner pipe 20 is formed in a pipe shape having a diameter D2 that is smaller than that of the outer housing 10 so that the air may flow through the inner pipe. The inner pipe 20 is formed at some portions of an entire length of the outer housing 10. The inner pipe 20 is disposed within the outer housing 10 so that the outer surface thereof is spaced apart from an inner surface of the outer housing 10 to partition the interior space in the outer housing 10 in the radial direction of the outer housing 10.

The inner pipe 20 is formed with a plurality of partition walls 21 and 22 for fixing the inner pipe 20 to the outer housing 10 and for forming a separate space between the inner pipe 20 and the outer housing 10. The partition walls 21 and 22 extend from the inner pipe 20 to the outer housing 10 to fix the inner pipe 20 to the inside of the outer housing 10.

The partition walls 21 and 22 are formed to be spaced apart lengthwise along the housing 10 from each other. Among the partition walls 21 and 22, a front partition wall 21 is formed closer to but spaced from a side at which the air is introduced, i.e., an air intake side, of the outer housing 10. The front wall partition 21 extends in a radial direction of the inner pipe 20 at a front end of the inner pipe 20. A rear partition wall 22 is formed to be spaced apart from the front partition wall 21 and toward or closer to an engine side of the outer housing 10. The rear partition wall 22 is formed at a position spaced apart from a rear end of the inner pipe 20 by a predetermined distance. More specifically, the front partition wall 21 is formed at the front end of the inner pipe 20, and the rear partition wall 22 is formed at or near a middle portion of the inner pipe 20. Therefore, the front partition wall 21 and the rear partition wall 22 are spaced apart from each other by a predetermined distance L1. Further, the rear partition wall 22 and the rear end of the inner pipe 20 are spaced apart from each other by a predetermined distance L2. Also, the distance L1 between the front partition wall 21 and the rear partition wall 22 may be selected or designed based on an engine displacement of the engine for which the air duct 1 is to be used. In one example, the distance L1 between the front partition wall 21 and the rear partition wall 22 is increased as an engine displacement is increases.

Figure 5:
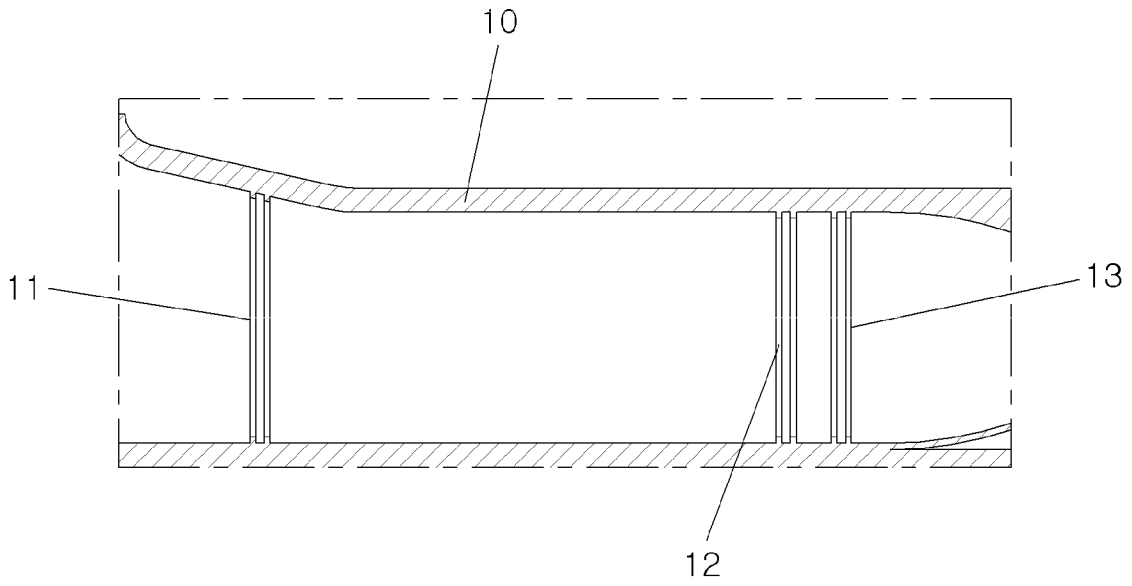
FIG. 5 is a cut-away perspective view illustrating the inside of the outer housing in the air duct of FIG. 2 and in accordance with the present disclosure.

As shown in FIG. 5, assembly grooves 11, 12, and 13 are formed in the inner surface of the outer housing 10 with which the partition walls 21 and 22 are assembled. A front assembly groove 11 is formed at a portion at which the front partition wall 21 is assembled, and rear assembly grooves 12 and 13 with which the rear partition wall 22 is assembled are formed at positions spaced apart from the front assembly groove 11 toward the engine.

The portion, i.e., the front assembly groove 11, at which the front partition wall 21 is assembled, is fixed in the outer housing 10. The rear assembly grooves 12 and 13 are formed in plural to accommodate a case in which the rear partition wall 22 is changed as the engine displacement is changed. For example, among the rear assembly grooves 12 and 13, a first rear assembly groove 12 is positioned at a relatively more forward position and may be used to assemble the inner pipe 20 that is used for a small displacement engine. A second rear assembly groove 13 is positioned at a relatively more rearward position, i.e., closer to the engine side of the air duct 1 than the first rear assembly groove 12 and may be used to assemble the inner pipe 20 that is used for a large displacement engine. There may, however, be more than two optional rear assembly grooves for situations where there are more than two engine displacement options. Further, there may be only one rear assembly groove for a situation where there is only one engine displacement option.

Figure 6:
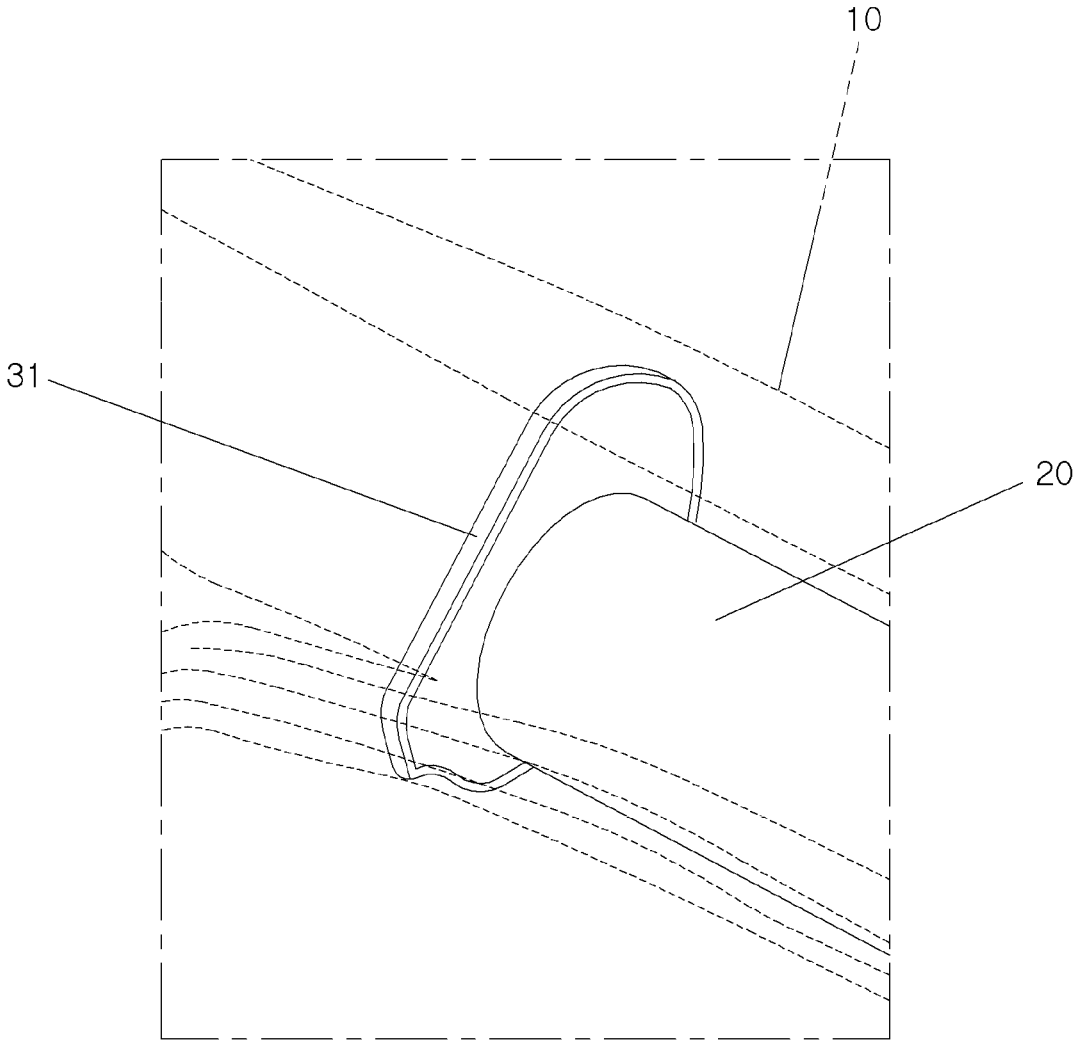
FIG. 6 is a perspective view illustrating the inner pipe coupled to the outer housing in the air duct of FIG. 2 and in accordance with the present disclosure.

As shown in FIG. 6, the front partition wall 21 and the rear partition wall 22 may closely adhere to or tightly contact the inner surface of the outer housing 10 through the assembly grooves 11, 12, and 13. An O-ring 31 may be installed around the circumferences of the front partition wall 21 and the rear partition wall 22 for air-tightness therebetween. Alternatively, such O-rings could be provided within the assembly grooves 11, 12, and 13. The O-ring 31 may be formed of a rubber or like material and is fitted around the circumferences of the front partition wall 21 and the rear partition wall 22. The O-rings 31 help create air-tightness, i.e., an air tight seal or contact between the circumferences of the front partition wall 21 and the rear partition wall 22, and the inner surface of the outer housing 10, thereby separating the space between the outer housing 10 and the inner pipe 20 from the space in the inner pipe 20.

A hole is formed at one side of and through the inner pipe 20. The hole provides air flow communication among the space defined between the outer housing 10 and the inner pipe 20 and the inside or interior of the inner pipe 20. The hole is formed between the front partition wall 21 and the rear partition wall 22. The hole is surrounded by and is formed with a neck 23 that extends from the inner pipe 20 toward the outer housing 10 at a predetermined length.

A diameter of the hole and a length of the neck 23 are determined depending on a frequency that is desired to be reduced. More specifically, the frequency tuned by the space between the inner pipe 20 and the outer housing 10 is determined by the following equation. An amount of air introduced into the space may be controlled by adjusting the diameter of the neck 23. The frequency to be tuned is changed depending on the length of the neck 23 in a state in which volume of the space between the outer housing 10 and the inner pipe 20 is determined.

$$f = \frac{c}{2\pi}\sqrt{\frac{S}{VL}}$$

In this equation, f represents the tuned frequency, c represents the velocity of sound, S represents the volume of the space between the outer housing and the inner pipe, V represents an amount of air introduced into the space, which is partly dependent on the diameter D of the hole, and L represents a length of the neck.)

The disclosed air duct for a vehicle functions to reduce intake noise with the foregoing configuration in accordance with the present disclosure. Since the inner pipe 20 serves as a silencer and is inserted or disposed within the outer housing 10, a separate space for installing a silencer may not be needed.

Further, the outer housing 10 may be a common part among a number of vehicle and engine specifications. Still further, the specification of the inner pipe 20 within the common outer housing 10 may be changed depending on the engine displacement or the frequency to be tuned.

The disclosed air duct for a vehicle functions to reduce intake noise with the foregoing configuration in accordance with the present disclosure. The disclosed air duct thus makes it possible to reduce intake noise by the space between the outer housing and the inner pipe during air intake into the engine through the air duct.

Since it is possible to reduce intake noise just by installing the inner pipe in the air duct without a separate silencer, a separate silencer for reducing intake noise need not be installed. The disclosed air duct thereby improves a degree of freedom in designing the engine compartment.

Further, since a separate silencer is not required, it is possible to reduce cost and weight of the air duct, and to simplify the specification or design of the air duct.

What is claimed is:

1. An air duct for a vehicle having a function of reducing intake noise, the air duct comprising:

an outer housing configured having a pipe shape to introduce outside air therethrough into an engine; and an inner pipe in the outer housing and configured so that an outer surface of the inner pipe is spaced apart from an inner surface of the outer housing, thereby partitioning the inside of the outer housing in a radial direction, wherein a space between the inner pipe and the outer housing communicates with the inside of the inner pipe, wherein partition walls extend from the inner pipe toward the outer housing, the partition walls defining portions at which the inner pipe is fixed to the outer housing, wherein the partition walls are disposed at plural at positions spaced apart from each other, wherein, among the partition walls, a front partition wall is formed at a side of the air duct at which the air is introduced, and wherein the front partition wall extends from a front end of the inner pipe in a radial direction, wherein, among the partition walls, a rear partition wall is spaced apart from the front partition wall, wherein assembly grooves are formed in the inner surface of the outer housing to accommodate the circumferential outer edges of the partition walls, wherein a rear assembly groove that accommodates the rear partition wall is formed in the inner surface of the outer housing at a predetermined position where the rear partition wall is positioned, wherein the rear assembly grooves are formed in plural to accommodate a case in which the rear partition wall is changed as the engine displacement is changed, wherein the rear partition wall is positioned spaced apart from a rear end of the inner pipe by a predetermined distance, wherein, the inner pipe is extended rearward from the rear partition wall, wherein a chamber for resonance is configured by the inner pipe, the outer housing and the rear partition wall, and the chamber is opened toward the engine, wherein the predetermined distance between the rear end of the inner pipe and the rear partition wall is greater than a gap between the inner pipe and the outer housing, wherein the predetermined distance between the rear end of the inner pipe and the rear partition wall is greater than a diameter of the inner pipe, wherein the inner pipe and the outer housing are of sufficient length and bent between the rear partition wall and the rear ends of the inner pipe and the outer housing, wherein a hole is formed through the inner pipe and provides air flow communication between the space defined within the inner pipe and the outer housing and the inside of the inner pipe, and wherein the hole is formed between the front partition wall and the rear partition wall, and is formed having a neck surrounding the hole and extending from the inner pipe toward the outer housing at a predetermined length.

2. The air duct of claim 1, wherein a distance between the front partition wall and the rear partition wall is greater to accommodate a larger engine displacement and lesser to accommodate a smaller engine displacement.

3. The air duct of claim 1, wherein circumferential outer edges of the partition walls closely contact the inner surface of outer housing.

4. The air duct of claim 1, wherein a front assembly groove that accommodates the front partition wall is formed in the inner surface of the outer housing at a predetermined position where the front partition wall is positioned.

5. The air duct of claim 3, wherein an O-ring is installed at the circumferential edges of each of the partition walls to form air-tight contact between the circumferential edges of each of the partition wall and the inner surface of the outer housing.

6. The air duct of claim 1, wherein a frequency to be reduced is determined by varying a diameter of the hole and a length of the neck.

* * * * *